US006877701B2

(12) United States Patent
Greubel

(10) Patent No.: US 6,877,701 B2
(45) Date of Patent: Apr. 12, 2005

(54) COIL HOSE SYSTEM

(76) Inventor: Philip Andrew Greubel, 19052 Willow Brook La., Trabuco Cyn., CA (US) 92679

( * ) Notice: Subject to any disclaimer, the term of this patent is extended or adjusted under 35 U.S.C. 154(b) by 0 days.

(21) Appl. No.: 10/184,308

(22) Filed: Jun. 27, 2002

(65) Prior Publication Data

US 2004/0000621 A1 Jan. 1, 2004

(51) Int. Cl.[7] ..... A47G 29/00
(52) U.S. Cl. ..... 248/87; 248/75; 248/80
(58) Field of Search ..... 248/87, 85, 80, 248/75, 76, 79, 126, 127; 137/355.12, 355.18; 138/178, 118; 239/196, 276

(56) References Cited

U.S. PATENT DOCUMENTS

| | | | | | |
|---|---|---|---|---|---|
| 750,742 | A | * | 1/1904 | Weston | 126/30 |
| 763,594 | A | * | 6/1904 | Chubb | 248/87 |
| 2,453,248 | A | | 11/1948 | Much | |
| 2,999,644 | A | | 11/1961 | Nobinger | |
| 3,021,871 | A | * | 2/1962 | Rodgers | 138/118 |
| 3,184,180 | A | * | 5/1965 | Rockwell | 242/399.2 |
| 3,597,846 | A | * | 8/1971 | Weiss | 433/77 |
| 3,599,917 | A | | 8/1971 | Schwartz | |
| 3,666,220 | A | * | 5/1972 | Rider | 248/52 |
| 3,826,288 | A | * | 7/1974 | Cooper et al. | 138/178 |
| 4,460,140 | A | * | 7/1984 | Ramazzotti et al. | 248/75 |
| 5,005,790 | A | | 4/1991 | Harris | |
| 5,203,526 | A | * | 4/1993 | Green et al. | 248/87 |
| 5,205,521 | A | * | 4/1993 | Smith | 248/87 |
| 5,390,695 | A | * | 2/1995 | Howard | 137/355.27 |
| 5,549,262 | A | * | 8/1996 | Whitehead | 248/87 |
| 5,806,814 | A | | 9/1998 | White | |
| 5,839,702 | A | | 11/1998 | Jette | |
| 6,059,215 | A | | 5/2000 | Finnis | |
| 6,478,265 | B1 | | 11/2002 | Leach | |
| 2002/0043594 | A1 | | 4/2002 | Kiry | |
| 2002/0074462 | A1 | | 6/2002 | Pontecorvo | |

OTHER PUBLICATIONS

Self Coiling Garden Hose (www.touchoforanges.com) Feb. 20, 2002.*

* cited by examiner

*Primary Examiner*—Leslie A. Braun
*Assistant Examiner*—Tan Le
(74) *Attorney, Agent, or Firm*—Stetina Brunda Garred & Brucker

(57) ABSTRACT

A coiled hose and system for storing the coiled hose are disclosed. The coiled hose has a memory for maintaining a consistent coiled configuration about a central axis. The coiled hose includes a kink resistor. The system for storing the coiled hose may be wall mountable or ground mountable.

15 Claims, 2 Drawing Sheets

COIL HOSE SYSTEM

CROSS REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention relates generally to hoses and more particularly to a coil hose and storage system.

Traditional hoses are bulky and difficult to store. They tangle easily and are cumbersome to move to and from a storage location. Because of the inconvenience of moving the hose to a storage location, they are typically left lying on the ground near the faucet in a jumbled pile. This is not only unsightly, but the hose tends to get dirty and slimy.

One of the recent methods to overcome some of the disadvantages of traditional hoses is a coiled hose. Coiled hoses are significantly more compact and thus easier to transport if storage away from the faucet is desired. Many people like to keep their hoses near the faucet so that they do not need to store them and retrieve them each time they want to use the hose. Thus, coiled hoses tend to be left lying on the ground near the faucet. Such storage, while an improvement over similar storage of a traditional hose, is still not ideal. The coiled hose is still on the ground and tends to get dirty and slimy.

Thus, there is a need for a method of neatly storing a hose near the faucet so that the hose is neatly stored off the ground so that is less likely to get dirty and slimy.

A further disadvantage of prior art coiled hoses is that the hoses are coiled over the entire length of the hose. This makes it difficult to stretch the hose to its maximum length without the hose kinking.

Thus, there is also a need for a coiled hose that can be stretched to its maximum length without kinking.

BRIEF SUMMARY OF THE INVENTION

An aspect of the present invention is a hose storage system for storing a coiled hose. The hose storage system includes a mountable storage post configured to hold the coiled hose in its coiled configuration.

The hose storage post may be wall mountable. The wall mountable storage post includes: a straight member for holding the coiled hose in its coiled configuration, a mounting member attachable to a wall, and a curved member for connecting the straight member to the mounting member such that the straight member is positionable in an upright position that is substantially parallel to the wall.

The hose storage post may be ground mountable. The ground mountable hose storage post includes: a straight member for holding the coiled hose in its coiled configuration, a ground stake, and a mounting member connectable to the ground stake and the straight member such that the mounting member is attached to the top of the ground stake such that the ground stake is in the ground and the mounting member rests on top of the ground and holds the straight member in an upwardly extending position that is substantially perpendicular to a top surface of the ground.

The storage post may be sizeable to fit a plurality of coiled hoses having different lengths. The storage post may be telescoping.

The mountable storage post may be a universal storage post that is wall mountable and ground mountable.

The coiled hose has a memory for maintaining a consistent coiled configuration about a central axis. The coiled hose includes a kink resistor. The kink resistor may include a straight portion at the end of the hose having a kink free connector to prevent kinking of the coiled hose.

Preferably, the coiled hose has a coiled length that is about 5% of the uncoiled length.

The coiled hose is made of a rugged, lightweight, abrasion-resistant polyurethane.

Preferably, the coiled hose has a rating of at least 100 psi. More preferably, the coiled hose has a rating of at least 150 psi. Preferably, the coiled hose has a burst pressure of at least 400 psi.

BRIEF DESCRIPTION OF THE DRAWINGS

These as well as other features of the present invention will become more apparent upon reference to the drawings wherein.

DETAILED DESCRIPTION OF THE INVENTION

Figure 2:
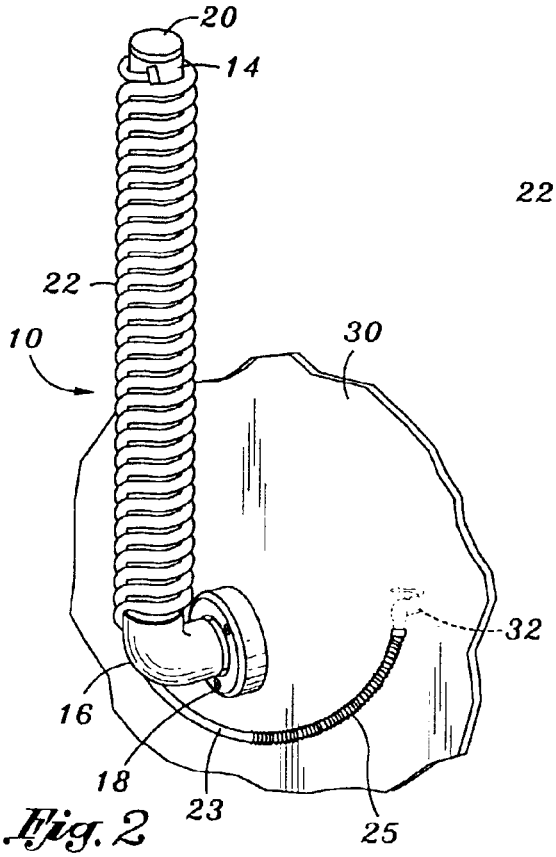
FIG. 2 is a perspective view of the coil hose and storage post system of FIG. 1 mounted on a wall.
Figure 3:
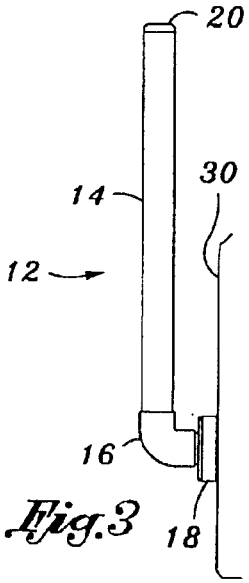
FIG. 3 is a side view of the storage post system of FIG. 1.
Figure 1:
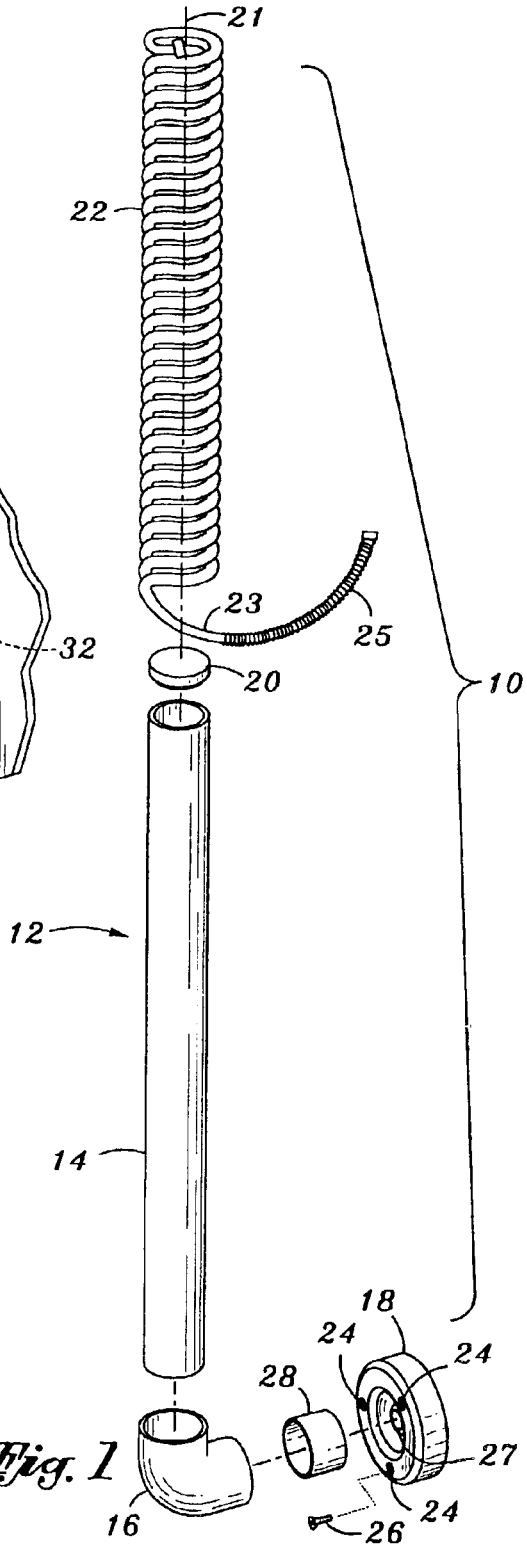
FIG. 1 is an exploded view of a coil hose and storage post system configured to be mounted on a wall.
Figure 4:
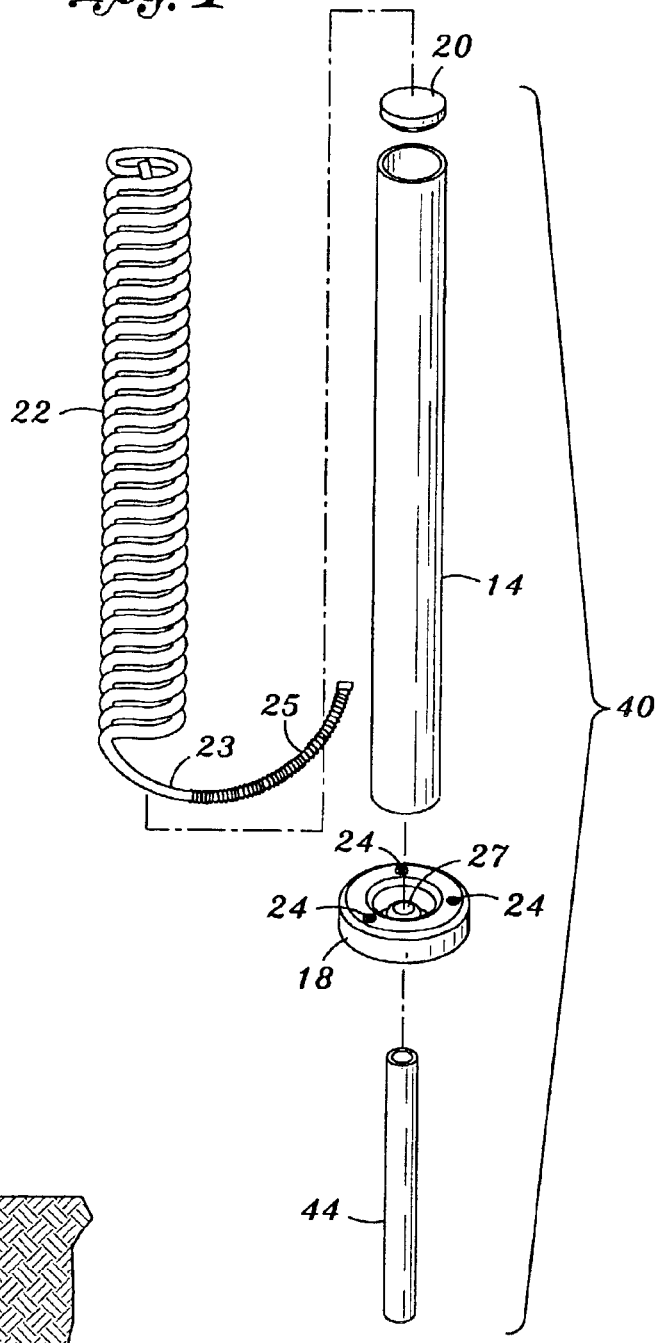
FIG. 4 is an exploded view of a coil hose and storage post system configured to be mounted in the ground.
Figure 5:
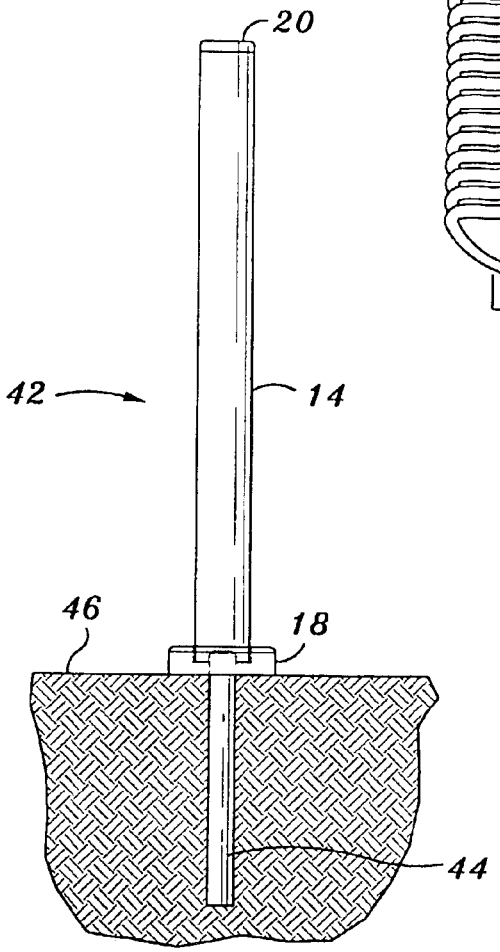
FIG. 5 is a perspective view of the storage post system mounted in the ground.

Referring now to the drawings wherein the showings are for purposes of illustrating preferred embodiments of the present invention only, and not for purposes of limiting the same, FIGS. 1–3 illustrate an embodiment of a coil hose and storage system 10 for mounting to a wall 30 and FIGS. 4–5 illustrate an alternative embodiment of a coil hose and storage system 40 for mounting in the ground 46. Each of these embodiments is described in further detail below.

Both the wall mountable hose storage system 10 and the ground mountable hose storage system 40 include a coiled host 22. The coiled hose 22 is coiled about a central axis and has a memory for maintaining a consistent coiled configuration about the central axis. The coiled hose 22 is made of a rugged, lightweight, abrasion-resistant material, such as a polyether based polyurethane. Preferably, the coiled hose 22 has a rating of at least 100 pounds per square inch (psi), and more preferably, a rating of at least 150 psi. Preferably the coiled hose has a burst pressure of at least 400 psi.

The coiled hose may be any one of a variety of lengths, for example, the coiled hose 22 may be twenty-five, feet in length, fifty feet in length or seventy-five feet in length. The coiled hose 22 is compact: a coiled hose 22 having a non-coiled length of twenty-five feet has a length of about fourteen inches in its coiled configuration, a coiled hose 22 having a non-coiled length of fifty feet has a length of about twenty-eight inches in its coiled configuration, and a coiled hose 22 having a non-coiled length of seventy-five feet has a length of about forty inches in its coiled configuration. Therefore, the coiled hose has a coiled length that is about 0.52 to 0.56 of the uncoiled length.

The coiled hose 22 of the present invention is kink resistant. The coiled hose 22 has a non-coiled end portion 23 that is attached to the faucet 32. Preferably, the non-coiled end portion 23 includes a tension relieving spring 25 to further aid in kink resistance. In exemplary embodiments, the tension relieving spring 25 is a tubular wire. The wire is made of a strong, flexible, weather-resistant material, such as aluminum or another metal or alloy having similar properties.

The coiled hose and storage post mounting system 10 shown in FIGS. 1–3 includes a coiled hose 22 and a storage post mounting system 12. The wall mountable storage post system 12 shown includes a straight member 14 for holding the coiled hose 22. The coiled hose 22 is lifted up and placed over the top of the straight member 14 of the storage post 12. If the coiled hose is long (e.g., thirty feet or more), placement of the coiled hose 22 over the straight member 14 of the storage post 12 may take multiple steps, i.e., placing a section of the coiled hose over the straight member and then repeating until all of the coiled hose 22 is positioned over the straight member 14.

As shown in FIG. 2, when the hose 22 is in its stored configuration, it is neat, out of the way and does not touch the ground. This is not only aesthetically pleasing but helps to prolong the life of the hose and aids in keeping the coiled hose 22 in its coiled configuration via gravity.

The wall mounted storage post 12 is mounted to a wall 30 having faucet 32. A mounting member 18 is attached to the wall 30. In the exemplary embodiment shown, the mounting member 18 has apertures 24. Attachment means 26, such as a screw may be placed through each of the apertures 24 and into the wall 30. It will be appreciated that any conventional attachments means may be used, for example, screws, nails, bolts or toggle bolts could be placed through the apertures 24 or the mounting member 18 could be attached to the wall using a suitable adhesive.

The mounting member 18 is located near the faucet 32 as shown in FIG. 1. The coiled hose 22 has a non-coiled portion 23 at one end. The hose end adjacent the non-coiled portion 23 of the coiled hose is attached to the faucet 32. The mounting member 18 should be mounted on the wall 30 at a distance from the faucet 32 that is shorter than the non-coiled portion 23 of the hose as shown in FIG. 1.

The wall mounted storage post 12 can be constructed of various materials. Exemplary embodiments of the storage post are made from a plastic material.

The wall mounted storage post 12 includes a curved member 16 that connects the mounting member 18 to the straight member 14 of the wall mounted storage post 12. When the straight member 14 is connected to the curved member 16, the straight member can be positioned so that it is substantially parallel to the wall 30.

Exemplary embodiments of the storage post 12 include a straight member 14 that is a sufficient length to hold hoses of various lengths. A storage post 12 having a straight member 14 that is forty inches long can hold a coiled hose 22 having a non-coiled length of up to seventy-five feet.

In exemplary embodiments, the consumer can cut the straight member 14 when it is used to hold shorter (e.g., less than thirty feet) hoses. A cap 20 can be placed over the top of the straight member 14. Exemplary embodiments may include notches to guide the consumer in cutting the straight portion to the appropriate length based on the size of the coiled hose 22.

Other embodiments include a telescoping straight member 14 having two straight members with an inner straight member housed within an outer straight member having a diameter that is of sufficient width to snugly hold the inner straight member. In exemplary embodiments the outer straight member is a sufficient length to hold a shorter (e.g., less than thirty feet) coiled hose. For example, the outer straight portion may be about twenty-one inches up to about thirty inches. The inner straight member is sized such that when it is in the telescoped extended configuration, larger hoses (e.g., seventy feet in the uncoiled configuration and about forty inches in the coiled configuration) can be stored. In exemplary embodiments, a latching mechanism locks the inner straight member in place when in the telescoped position. For example, a detent latching mechanism that may be used.

The wall mounted storage post system can be assembled by attaching the mounting bracket 18 to the wall 30 in the desired location. The wall mounting bracket 18 includes a recess 27. In exemplary embodiments, the recess 27 is sized to fit the curved member 16. In other embodiments, the recess 27 does not directly fit the curved member. In these embodiments, a connecting member 28 is configured to connect the curved member 16 to the mounting member 18. The curved member 16 is then connected to the connecting member 28 (or directly to the mounting member 18) such that the open (not yet attached) end of the curved member 16 is pointing upward. The straight member is then placed in the hole of the open end of the curved member 16 such that the straight member is substantially parallel to the wall 30. The straight member 14 can be sized (e.g., cut) prior to placing it in the curved member 16. The mounting post can be finished off by placing a cap 20 on the top (open end) of the straight member 14.

The coil hose and storage system 40 for mounting in the ground 46 shown in FIGS. 4 and 5 includes a coiled hose 22 and a ground mountable storage post 42. Like the wall mountable storage post 12, the ground mountable storage post 42 includes a straight member 14 for holding the coiled hose 22 in its coiled configuration. A ground stake 44 is placed in the ground, e.g., in dirt, soil or grass such that the majority of the ground stake 44 is under the ground 46 and there is an exposed top portion of the ground stake 44 above the ground 46. The bottom of the mounting member 18 has a recess configured to fit the ground stake 44. The mounting member 18 is placed on the top of the ground 46 such that the exposed portion of the stake 44 fits in the recess on the under side of the mounting member 18. The straight member 14 is then placed in the recess 27 on the upper side of the mounting member 18 such that the straight member 14 is substantially perpendicular to the ground 46. The straight member 14 of the ground mountable storage post 42 can be adjusted for various sizes of coiled hoses 22 as described above in connection with the wall mountable storage post 12.

Most of the components of the ground mountable storage post 42 are the same as those of the wall mountable storage post 12. Due to the commonality, a universal coiled hose mounting post system or kit comprises the components used in either embodiment. The universal coiled hose mounting kit includes: a straight member 14 (used in either configuration), a mounting bracket 18 (used in either configuration), a curved member (used in the wall mountable configuration), and a stake (used in the ground mountable configuration). The universal hose mounting kit may also include a connecting member 28. Attachment means 26 may also be included in the universal hose mounting kit.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A hose system comprising:

a coiled hose having memory for maintaining a consistent coiled configuration about a central axis, the coiled hose having a non-coiled end portion attachable to a faucet;

a spring disposed around the non-coiled end portion and being configured to relieve tension thereat to prevent kinking of the coiled hose; and a ground mounted storage post configured to hold the coiled hose in its coiled configuration about the central axis.

2. The hose system of claim 1, wherein the coiled hose has a coiled length and an uncoiled length with the coiled length being about 0.52 to about 0.56 of the uncoiled length.

3. The hose system of claim 1, wherein the coiled hose is made of a rugged, lightweight, abrasion-resistant polyether based polyurethane.

4. The hose system of claim 1, wherein the coiled hose has a rating of at least 100 psi.

5. The hose system of claim 1, wherein the coiled hose has a rating of at least 150 psi.

6. The hose system of claim 1, wherein the coiled hose has a burst pressure of at least 400 psi.

7. The hose system of claim 1, wherein the mountable storage post is wall mounted.

8. The hose system of claim 1, wherein the mountable storage post is sizeable to fit a plurality of coiled hoses having different lengths.

9. A hose system comprising:

a coiled hose having memory for maintaining a consistent coiled configuration about a central axis, the coiled hose having a non-coiled end portion attachable to a faucet;

a spring disposed around the non-coiled end portion and being configured to relieve tension thereat to prevent kinking of the coiled hose; and a mountable storage post configured to hold the coiled hose in its coiled configuration about the central axis, wherein the mountable storage post is telescoping to fit hoses having different lengths.

10. The hose system of claim 9, wherein the coiled hose has a coiled length and an uncoiled length with the coiled length being about 0.52 to about 0.56 of the uncoiled length.

11. The hose system of claim 9, wherein the coiled hose is made of a rugged, lightweight, abrasion-resistant polyether based polyurethane.

12. The hose system of claim 9, wherein the coiled hose has a rating of at least 100 psi.

13. The hose system of claim 9, wherein the coiled hose has a rating of at least 150 psi.

14. The hose system of claim 9, wherein the coiled hose has a burst pressure of at least 400 psi.

15. The hose system of claim 9 further comprising a ground stake, and wherein the mountable storage post is engagable to the ground stake to be ground mounted.

* * * * *